US005361619A

United States Patent [19]

Kojima et al.

[11] Patent Number: 5,361,619

[45] Date of Patent: Nov. 8, 1994

[54] PROCESS AND APPARATUS FOR PRESS FORMING

[75] Inventors: Ichirou Kojima, Ichinomiya; Terumi Nishida, Nukata; Kunio Yamada, Anjo, all of Japan

[73] Assignee: Nippondenso Co., Ltd., Kariya, Japan

[21] Appl. No.: 113,791

[22] Filed: Sep. 1, 1993

[30] Foreign Application Priority Data

Sep. 2, 1992 [JP] Japan ..... 4-234643

[51] Int. Cl.[5] ..... B21D 22/26

[52] U.S. Cl. ..... 72/348

[58] Field of Search ..... 72/347, 348, 332

[56] References Cited

U.S. PATENT DOCUMENTS

| | | | |
|---|---|---|---|
| 1,184,009 | 5/1916 | O'Leary | 72/347 |
| 1,442,912 | 1/1923 | Stoddard | 72/348 |
| 2,390,359 | 12/1945 | Ernst | 72/348 |

FOREIGN PATENT DOCUMENTS 443298 2/1992 Japan .

OTHER PUBLICATIONS

Iseki et al: "Flexible Die Assembly of Combined Unit Block Tools", 41st Conference of Plastic Working League, 1-3 Oct. 1990.

*Primary Examiner*—Lowell A. Larson
*Attorney, Agent, or Firm*—Cushman, Darby & Cushman

[57] ABSTRACT

To produce deep-drawn articles having various lengths by effecting forming and trimming without an increase in the production cast, a process comprises the steps of: a first step of press-forming a blank in the portions corresponding to both ends of a deep-drawn product having a desired length to form a semi-deep-drawn product in the form of a vessel having both ends deep-drawn to a vessel form and an unformed mid-length portion; and a second step of press-forming the unformed mid-length portion of the semi-deep-drawn product to complete a deep-drawn product in the form of a vessel. An apparatus for carrying out the process comprises: a first die assembly having dies and punches disposed facing each other and movable corresponding to both ends of a deep-drawn product, to form the semi-deep-drawn product having both ends deep-drawn to a vessel form and an unformed mid-length portion not deep-drawn; and a second die assembly with dies and punches disposed corresponding to the unformed portion, to press-form the unformed portion thereby completing a deep-drawn product.

10 Claims, 7 Drawing Sheets

PROCESS AND APPARATUS FOR PRESS FORMING

BACKGROUND OF THE INVENTION

1. Field of the Invention

The present invention relates to a process of press-forming deep-drawn products having different lengths and an apparatus for carrying out the process.

2. Description of the Related Art

A known press-forming process uses a die composed by combining unit block tools to produce deep-drawn products with arbitrary shapes. Specifically, a plurality of unit block tools having selected shapes are combined to form a punch, a die and a blank holder so that deep-drawn products having different shapes can be produced. This enables press-forming die assemblies having different shapes to be provided by combining a plurality of unit block tools, and thus, deep-drawn products having different lengths can be press-formed without an increase in the number of press-forming die assemblies.

The conventional art, however, has a problem that a die assembly of combined unit block tools cannot simultaneously effect press-forming and trimming, and therefore, the die assembly must be changed to produce a deep-drawn product having a different length when the press-forming process includes trimming as well as forming. Particularly, to produce deep-drawn products with different lengths varying at small pitches, a great number of die assemblies must be prepared accordingly, which requires a heavy die cost and much time for changing die assemblies, lowering the rate of operation, and thereby increasing the gross production cost.

SUMMARY OF THE INVENTION

The object of the present invention is to provide a process and an apparatus for press-forming deep-drawn products having different lengths, in which forming and trimming can be effected without an increase in the production cost.

To achieve the object according to the present invention, there is provided a process of press-forming deep-drawn articles in the form of a vessel having different lengths, from blanks in the form of a sheet, the process comprising the steps of:

a first step of press-forming a blank in the portions corresponding to both ends of a deep-drawn product having a desired length to form a semi-deep-drawn product in the form of a vessel having both ends deep-drawn to a vessel form and an unformed mid-length portion; and a second step of press-forming the unformed mid-length portion of the semi-deep-drawn product to complete a deep-drawn product in the form of a vessel.

Typically, the first step may further include a substep of trimming to cut scrap formed as a rim surrounding both ends of the semi-deep-drawn product.

The second step may preferably further include, after forming of the unformed portion, a substep of trimming to cut scrap formed as a rim surrounding the unformed portion and to remove scrap formed as a rim surrounding said both ends and said unformed portion of said semi-deep-drawn product.

According to the present invention, there is also provided an apparatus for press-forming deep-drawn articles in the form of a vessel having different lengths, from blanks in the form of a sheet, the apparatus comprising:

a first press-forming die assembly provided with dies and punches disposed facing each other and movable corresponding to lengths of both ends of a deep-drawn product in the form of a vessel having a desired length, the dies and punches being mutually engageable to form a semi-deep-drawn product in the form of a vessel having both ends deep-drawn to a vessel form and an unformed mid length portion; and a second press-forming die assembly provided with dies and punches disposed corresponding to the unformed portion, the dies and punches being mutually engageable to press-form the unformed portion thereby completing a deep-drawn product.

Typically, the first press-forming die assembly may further comprise positioning means which moves and positions the dies and punches to selected positions.

The first press-forming die assembly may be preferably provided with upper and lower bases; a set of two punches movably mounted on one of the bases and having shapes corresponding to both ends of a deep-drawn product in the form of a vessel; a set of two dies movably mounted on the other of the bases having shapes corresponding to those of the punches; one of the set of dies and the set of punches being positioned at a selected distance therebetween thereby positioning the other of the set of dies and the set of punches at a selected distance therebetween, by the positioning means.

The apparatus may preferably further comprise a center punch disposed on one of the bases perpendicularly to the longitudinal direction of the deep-drawn product in the form of a vessel to prevent inward buckling of the deep-drawn product during press-forming.

Preferably, disposed surrounding the punch are a trimming punch to separate scrap of a blank from a deep-drawn product and a scrap cutter to cut away the scrap.

The second press-forming die assembly may be preferably provided with upper and lower bases; a forming punch disposed on one of the bases to press-form the unformed portion; a pair of pilot punches movably disposed outside the forming punch at positions corresponding to the length of the semi-deep-drawn product on the one of the bases; and a die disposed on the other of the bases and having a forming groove corresponding to the shape of the forming punch.

The second press-forming die assembly may preferably include positioning means for positioning the pair of pilot punches in selected positions so that the pilot punches move the same distance toward or away from the center of the forming punch.

DESCRIPTION OF THE PREFERRED EMBODIMENTS

Example

Figure 1:
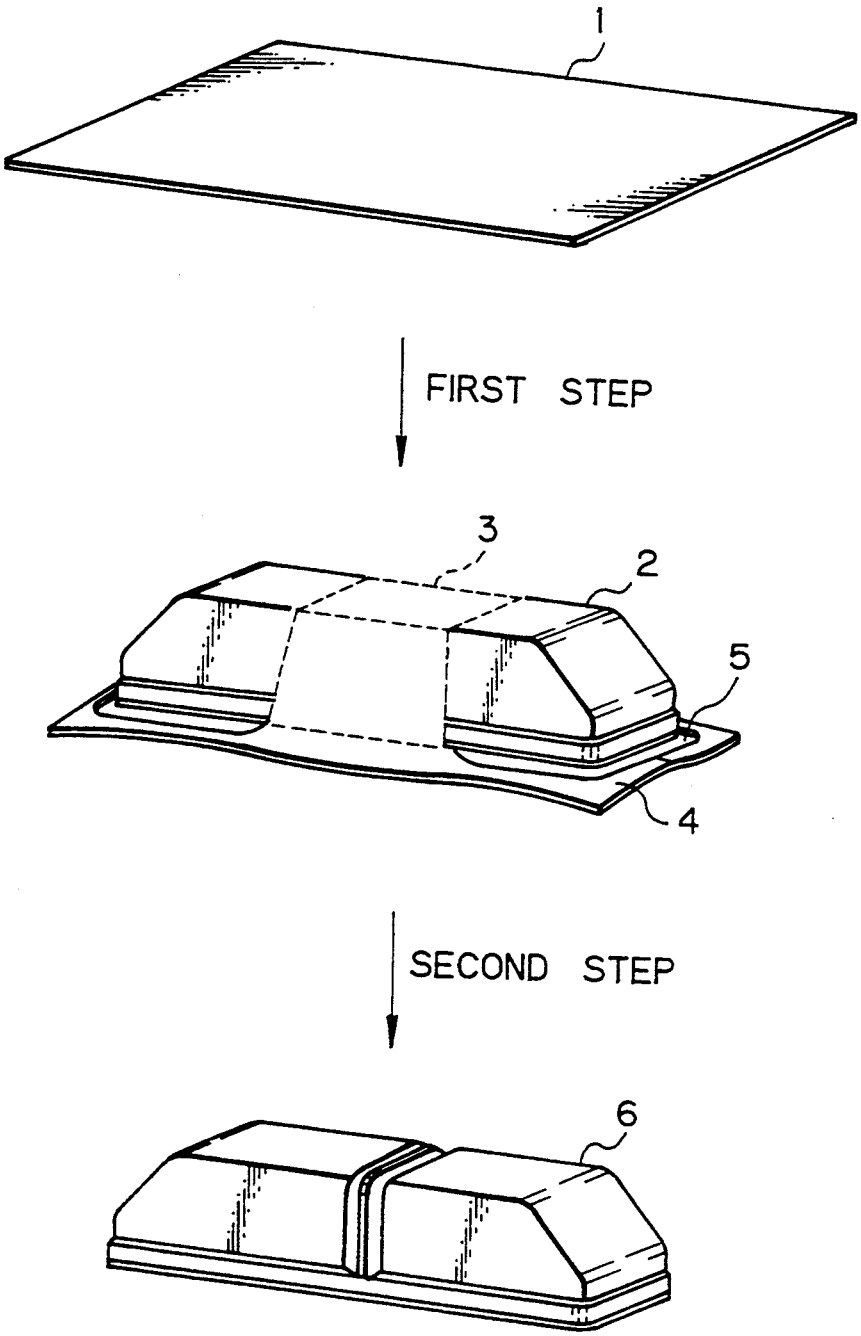
FIG. 1 schematically illustrates a process sequence according to a preferred embodiment of the present invention.

FIG. 1 schematically illustrates a process sequence for press-forming an aluminum heater capsule.

In the first forming step, a blank 1 in the form of a rectangular plate is deep-drawn in both ends to form a semi-deep-drawn product 2 in the form of a vessel, having an uniformed portion 3 in the middle shown as the area bordered by broken lines. A scrap 4 in the form of a rim is connected to the semi-deep-drawn product 2 in the middle and is separated from the semi-deep-drawn product 2 by a trimming line 5 in the ends.

In the second forming step, the unformed portion 3 is deep-drawn to complete a deep-drawn product or aluminum heater capsule.

The first and second forming steps are carried out by using the press forming die assemblies as shown in FIGS. 2 to 6.

Figure 2:
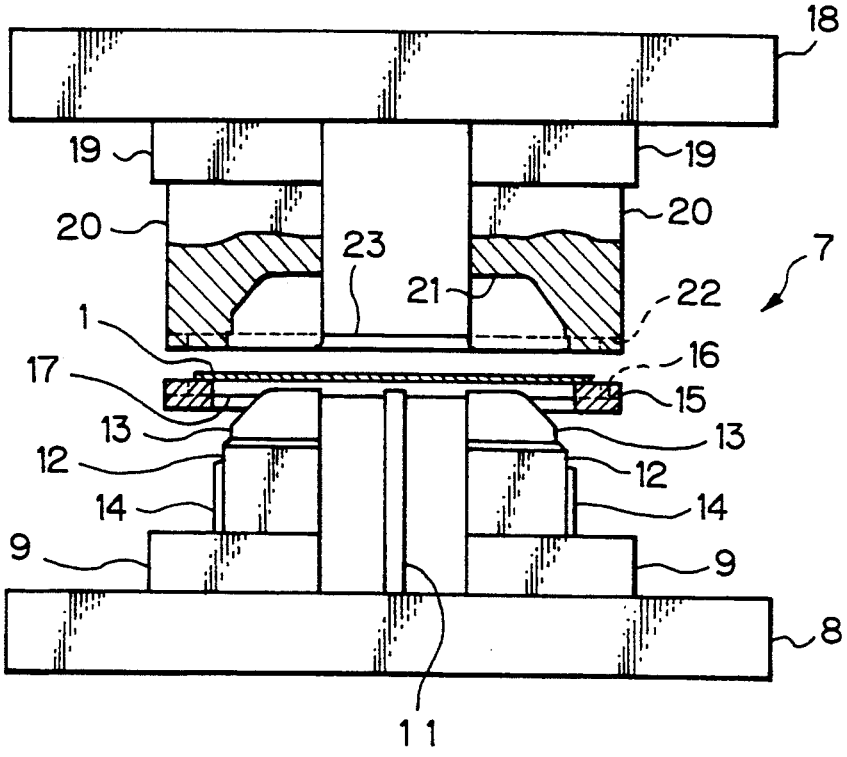
FIG. 2 shows a first press-forming die assembly according to the present invention, in a front view.
Figure 3:
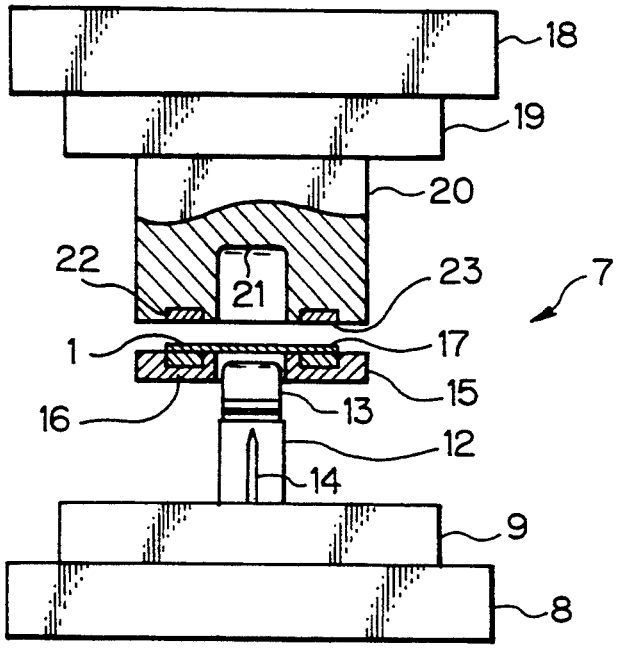
FIG. 3 shows the first die assembly of FIG. 2 in a side view.
Figure 4:
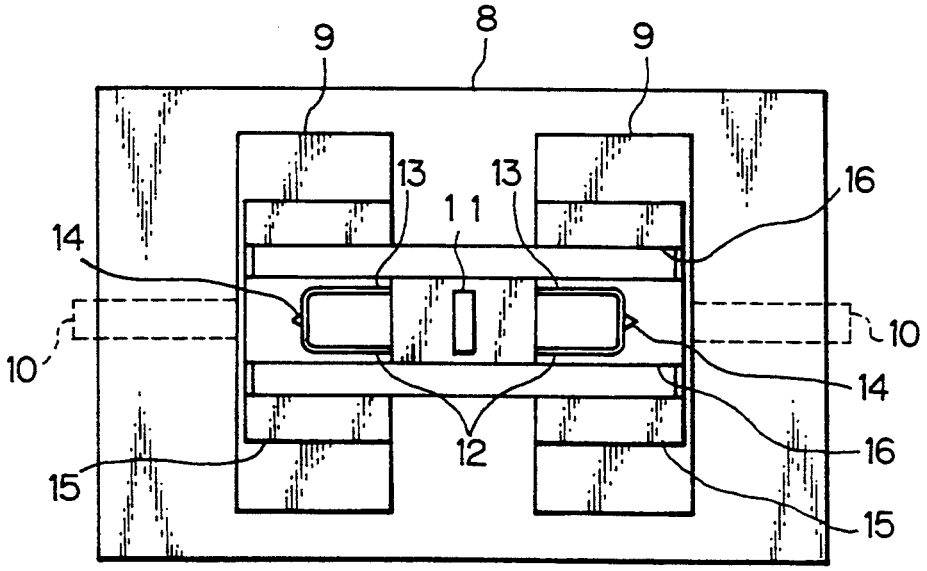
FIG. 4 shows the first die assembly of FIG. 2 in a plan view.

FIGS. 2, 3 and 4 show a press forming die assembly for carrying out the first forming step, in front, side and plan views, respectively.

A press forming die assembly 7 has a lower base 8, on which a pair of lower subdie-setting tables 9 are disposed apart from each other at a selected distance. The lower subdie-setting tables 9 are positioned by a positioning device 10 provided in the lower base 8, as shown in FIG. 4. The positioning device 10 automatically positions the lower subdie-setting tables 9 in lateral symmetry about the center of the lower base 8, at which center a center punch 11 is fixed upright.

A trimming punch 12 is fixed upright on each of the lower subdie-setting tables 9. A forming punch 13 is fixed on the top of the trimming punch 12 and a scrap cutter 14 is disposed on the side wall of the trimming punch 12. The forming punches 13 are positioned by moving the lower tables 9 in accordance with the longitudinal dimension of the completed product 6.

Cushions 15 are positioned at a selected height above the lower tables 9. Guide posts and compression coil springs, both not shown, are interposed between the cushions 15 and the lower tables 9 to enable the cushions 15 to be moved laterally by the guide posts in accordance with the movement of the lower tables 9 and to be moved downward with an upward pressure maintained by the coil springs.

The cushions 15 each has a pair of grooves 16 formed in the upper surface thereof. A pair of slender parallel plate cushions 17 bridge the cushions 15, with both ends of the former engaged in the grooves 16 of the latter. The plate cushions 17 are kept in the position shown, irrespective of the movement of the lower tables 9.

The first press forming die assembly 7 has an upper base 18, on the lower side of which a pair of laterally movable upper subdie-setting tables 19 are mounted apart from each other at a selected distance. The upper subdie-setting tables 19 are connected to the lower subdie-setting tables 9 via not-shown guide posts to be moved in accordance with the movement of the lower tables 9 caused by the positioning device 10.

A die 20 is fixed to each of the upper subdie-setting tables 19. Each die 20 has a molding cavity 21 corresponding to the shape of the forming punch 13. A pair of grooves 22 are provided in the bottom of the die 20 face-to-face with the grooves 16 of the cushions 15. A pair of slender parallel plate dies 23 bridge the dies 20, with both ends of the former engaged in the grooves 22 of the latter, and facing the plate cushions 17. The plate dies 23 are kept in the position shown, irrespective of the movement of the upper tables 19.

The dies 20 have not-shown knock-out pins to push out a press-formed product therefrom.

The molding cavities 21 of the dies 20 have side walls inclined outward so that a transition portion between the scrap 4 and the unformed portion 3 is not subjected to undesired deformation when trimming the scrap 4 away from the semi-deep-drawn product 2.

Figure 5:
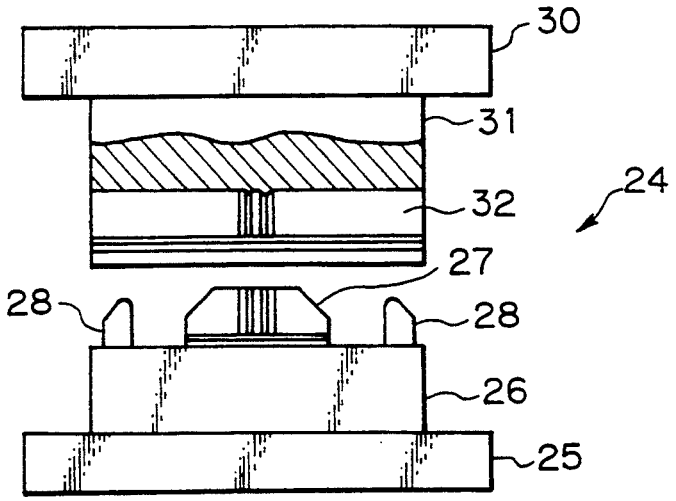
FIG. 5 shows a second press-forming die assembly according to the present invention, in a front view.
Figure 6:
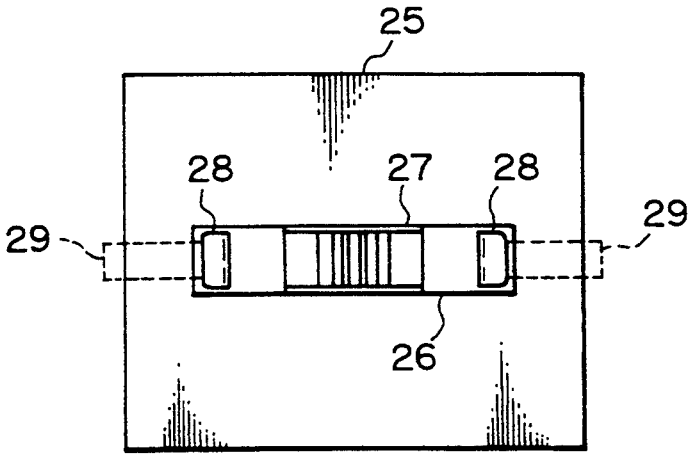
FIG. 6 shows the second die assembly of FIG. 5 in a plan view.

FIGS. 5 and 6 show a second press forming die assembly for carrying out the second forming step shown in FIG. 1, in side and plan views, respectively.

Referring to FIG. 5, a second press forming assembly 24 has a lower base 25, on which a trimming punch 26 is fixed. A forming punch 27 is fixed on the trimming punch 26. A pair of pilot punches 28 are movably mounted on the lower base 25 and extent through and extrude above the trimming punch 26. The pilot punches 28 are positioned by a positioning device 29 shown in FIG. 6, in accordance with the longitudinal dimension of a final product 6 as shown in FIG. 1.

A die 31 is fixed to an upper base 30 and has a molding groove 32 corresponding to the shape of the forming punch 27.

FIGS. 7 to 13 illustrate a process sequence according to the present invention.

As shown in FIG. 2, a blank 1 is placed in position on the plate cushions 17 of the first assembly 7. A not-shown press machine is then operated to lower the die 20 so that the rim of the blank 1 is nipped between the plate dies 23 and the plate cushions 17. As the die 20 is lowered further, the forming punch 13 intrudes into the molding cavity 21 of the die 20 thereby deep-drawing the ends of the blank 1.

Figure 7:
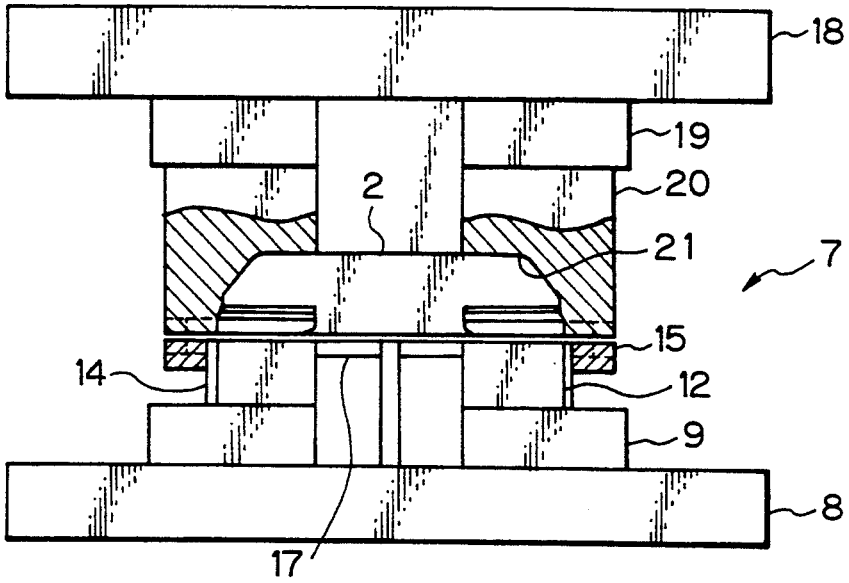
FIGS. 7 and 8 show the first die assembly of FIG. 2 in operation, in front and side views, respectively.
Figure 8:
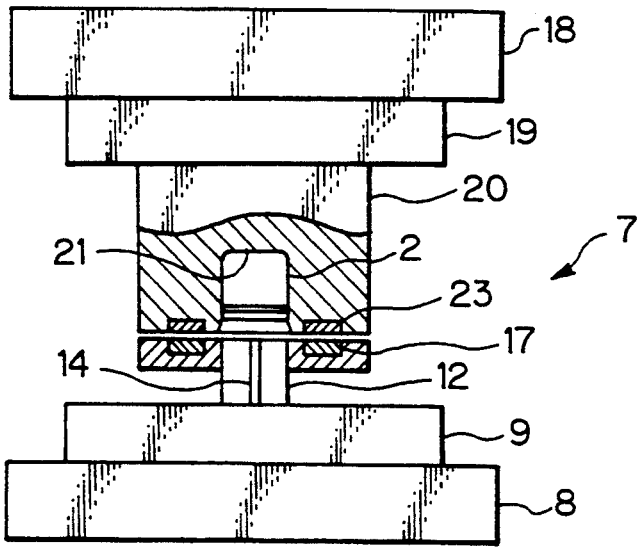

As the die 20 is lowered even further as shown in FIGS. 7 and 8, the die 20 passes the cutting edge of the trimming punch 12 to effect trimming, and when lowered to the lower dead point, the die 20 completely engages with the forming punch 13 to complete the first forming step by the first die assembly 7, providing a semi-deep-drawn product 2.

The mid-length portion of the semi-deep-drawn product 2 is not brought into contact with the die assembly 7 but is dragged by the formed ends during forming, thereby exhibiting the vessel-like appearance as shown in FIG. 1.

The scrap 4 is separated from the semi-deep-drawn product 2 in the end portions by the scrap cutter 14 and the die 20 which engage with each other when the die 20 is lowered to the lower dead point.

Figure 9:
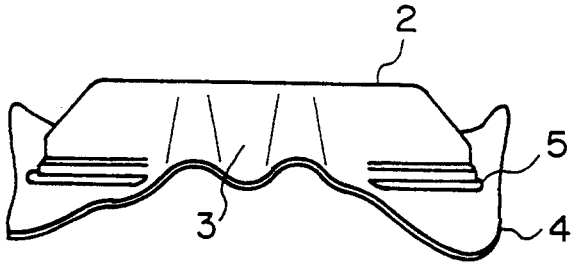
FIG. 9 shows, in a front view, a semi-deep-drawn product when unsuccessfully press-formed in the first forming step, in which buckling occurs in the mid length portion.

When the unformed mid-length portion 3 of the semi-deep-drawn product 2 is long and the blank is not mechanically constrained during the first forming step, buckling occurs in the mid-length portion 3 as shown in FIG. 9, because the material of the blank 1 is biased to flow excessively from the end portions to the mid-length portion 3 by a flange resistance against deformation of the corners of the end portions of the product 2.

Figure 10:
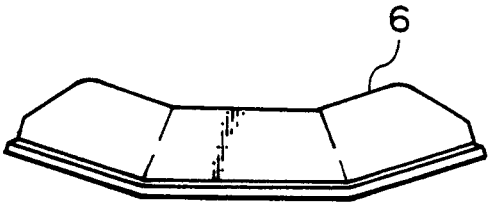
FIG. 10 shows, in a front view, a final deep-drawn product press-formed from the semi-deep-drawn product of FIG. 9 in the second forming step, in which the both ends rise.

If a semi-deep-drawn product 2 having such a buckling is subjected to the second forming step, the excess material in the mid-length portion 3 causes both ends of the final product 6 to undesirably rise as shown in FIG. 10, and the irregularity of the trimmed portion 4 increased the occurrence of burrs.

In this example according to the present invention, an inward buckling is prevented by nipping and pulling the unformed edge portions of the blank 1 by the plate dies 23 and the plate cushions 17 and by provision of the center punch 11.

When the final product 6 is small in longitudinal dimension, and accordingly, the lower subdie-setting tables 9 must be closer to each other, the center punch 11 can be withdrawn into the lower base 8 to become ineffective.

Figure 11:
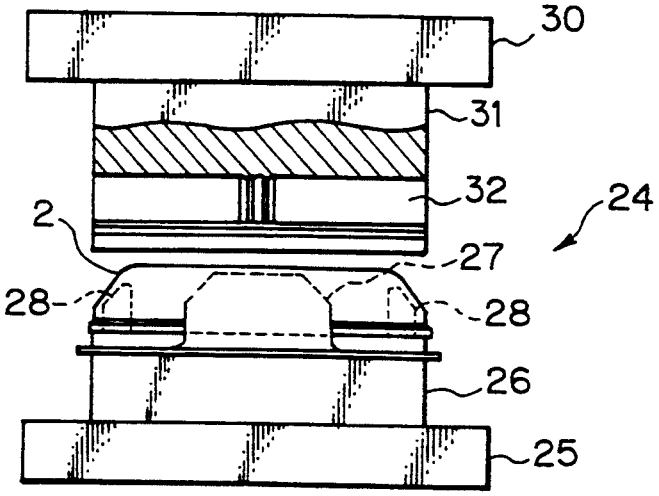
FIG. 11 shows the second die assembly of FIG. 5 in operation with a semi-deep-drawn product charged therein, in a front view.

The semi-deep-drawn product 2 from the first die assembly 7 is then charged in the second die assembly 24. Specifically, the ends of the semi-deep-drawn product 2 are engaged in the pilot punches 28 of the second die assembly 24, as shown in FIG. 11. The scrap 4, in the end portions thereof, has been separated from the semi-deep-drawn product 2 by the scrap cutter 14, and therefore, the semi-deep-drawn product 2 is prevented from running onto the scrap 4 to ensure a proper positioning for trimming.

When a not-shown press machine is operated, the die 31 is lowered so that the unformed mid-length portion 3 of the semi-deep-drawn product 2 is subjected to press forming and trimming to finish the second forming step by the second die assembly 24, thereby completing the deep-drawn product 6 in the form of a vessel.

To press-form final products 6 having different lengths, the first forming step is carried out by resetting the lower subdie-setting tables 9 (or forming punches 12) of the first die assembly 7 in the positions corresponding to the different lengths of the final products 6. The second forming step is then carried out by resetting the pilot punches 28 of the second die assembly 24 in the positions corresponding to the different lengths of the final products 6.

Figure 12:
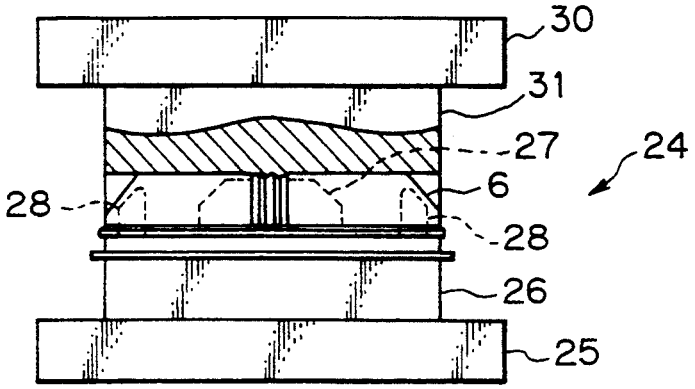
FIG. 12 shows the second die assembly of FIG. 5 in operation when press-forming a shorter semi-deep-drawn product, in a front view.
Figure 13:
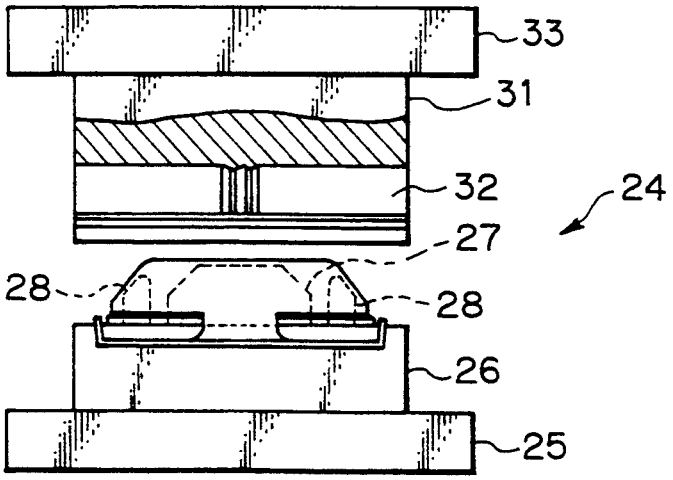
FIG. 13 shows the second die assembly of FIG. 5 in operation when press-forming a semi-deep-drawn product having a length intermediate between those of FIGS. 7 and 11, in a front view.

FIGS. 12 and 13 show long and medium length semi-deep-drawn products 2 are charged in the second die assemblies 24, respectively.

The conventional press forming process using a combination of unit block tools having a unit length of 12.6 cm, required seven dies and 15 min for arrangements per shot or die to produce an aluminum heater capsule having a length of $102.5+12.6n$ ($n=0$ to 6) cm.

In contrast, the press forming process of this example according to the present invention requires only two die assemblies and 10 sec for arrangements per shot to produce an aluminum heater capsule having a length of from 102.5 to 178.1 cm.

In this example according to the present invention, the first forming step is carried out by positioning the lower subdie-setting tables 9 of the first die assembly 7 in accordance with the length of the final product 6 to press-form and trim a semi-deep-drawn product 2 and the second forming step is then carried out by positioning the pilot punches 28 of the second die assembly 24 in accordance with the length of the final product 6. Thus, this process is remarkably advantageous over the conventional press forming process in that a final product 6 having an arbitrary length can be press-formed and trimmed by the first and second forming steps using the first and second press-forming die assemblies 7 and 24, so long as the distance between the forming punches 13 or forming dies 20 is not greater than the length of the final product. Therefore, to demonstrate the distinctive feature of the present invention over the conventional art using the combination of unit block tools, the present invention can effect press forming and trimming simultaneously in accordance with different lengths of final products, so that deep-drawn products 6 with arbitrary lengths within a limited range can be completed through only two forming steps or two forming die assemblies.

A pair of pilot punches 28 may be individually positioned in the second die assembly, instead of being positioned in lateral symmetry as used in this example. In this case, when punch and die for forming beads are provided in the middle of the molding groove 32 of the die 31, the position of the beads can be changed in accordance with the change of the length of the final deep-drawn product 6.

The present invention is also applicable when the width of the final product 6 is varied, instead of the length as mentioned in this example.

The scrap cutter 14 is provided in the first die assembly 7 to separate the scrap 4 in the end portions of the semi-deep-drawn product 2, and therefore, may be omitted if the scrap 4 is completely removed in the end portions by using an adjusted width of the blank 1 or if an additional step of cutting the scrap 4 is inserted between the first and second forming steps.

In the first forming step or first die assembly, the center punch 11, the plate dies 23 and the plate cushions 17 may be omitted when the semi-deep-drawn product 2 has a short unformed portion 3.

As hereinabove described, in the process and apparatus according to the present invention, the end portions of a blank are press-formed and trimmed to a semi-deep-drawn product, which is then press-formed and trimmed in the unformed mid-length portion to complete a deep-drawn product in the form of a vessel, so that formed products having different lengths can be produced through only two steps of forming or two die assemblies, without an increase in the production cost.

We claim:

1. A process of press-forming deep-drawn articles in the form of a vessel having different lengths, from blanks in the form of a sheet, said process comprising the steps of:

a first step of press-forming a blank in the portions corresponding to both ends of a deep-drawn product having a desired length to form a semi-deep-drawn product in the form of a vessel having both ends deep-drawn to a vessel form and an unformed mid-length portion; and a second step of press-forming said unformed mid-length portion of said semi-deep-drawn product to complete a deep-drawn product in the form of a vessel.

2. A process according to claim 1, wherein said first step further comprises a substep of trimming to cut scrap formed as a rim surrounding said both ends of said semi-deep-drawn product.

3. A process according to claim 2, wherein said second step further comprises, after forming of said unformed portion, a substep of trimming to cut scrap formed as a rim surrounding said unformed portion and to remove scrap formed as a rim surrounding said both ends and said unformed portion of said semi-deed-drawn product.

4. An apparatus for press-forming deep-drawn articles in the form of a vessel having different lengths, from blanks in the form of a sheet, said apparatus comprising:

a first press-forming die assembly provided with dies and punches disposed facing each other and movable corresponding to lengths of both ends of a deep-drawn product in the form of a vessel having a desired length, said dies and punches being mutually engageable to form a semi-deep-drawn product in the form of a vessel having both ends deep-drawn to a vessel form and an unformed mid-length portion; and a second press-forming die assembly provided with dies and punches disposed corresponding to said unformed portion, said dies and punches being mutually engageable to press-form said unformed portion thereby completing a deep-drawn product.

5. An apparatus according to claim 4, wherein said first press-forming die assembly further comprises positioning means which moves and positions said dies and punches to selected positions.

6. An apparatus according to claim 5, wherein said first press-forming die assembly is provided with upper and lower bases; a set of two punches movably mounted on one of said bases and having shapes corresponding to both ends of a deep-drawn product in the form of a vessel; a set of two dies movably mounted on the other of said bases having shapes corresponding to those of said punches; one of said set of dies and said set of punches being positioned at a selected distance therebetween thereby positioning the other of said set of dies and said set of punches at a selected distance therebetween, by said positioning means.

7. An apparatus according to claim 6, further comprising a center punch disposed on one of said bases perpendicularly to the longitudinal direction of said deep-drawn product in the form of a vessel to prevent inward buckling of said deep-drawn product during press-forming.

8. An apparatus according to claim 6, wherein disposed surrounding said punch are a trimming punch to separate a scrap of a blank from a deep-drawn product and a scrap cutter to cut away the scrap.

9. An apparatus according to claim 5, wherein said second press-forming die assembly is provided with upper and lower bases; a forming punch disposed on one of said bases to press-form said unformed portion; a pair of pilot punches movably disposed outside said forming punch at positions corresponding to the length of said semi-deep-drawn product on said one of said bases; and a die disposed on the other of said bases and having a forming groove corresponding to the shape of said forming punch.

10. An apparatus according to claim 9, wherein said second press-forming die assembly includes positioning means for positioning said pair of pilot punches in selected positions so that said pilot punches move the same distance toward or away from the center of said forming punch.

* * * * *